United States Patent [19]

DuBroff et al.

[11] Patent Number: 4,528,069

[45] Date of Patent: Jul. 9, 1985

[54] SOLVENT PRETREATMENT OF COAL TO IMPROVE COKE STRENGTH

[75] Inventors: William DuBroff, Munster; Dennis D. Kaegi, Crown Point; Jerome J. Knoerzer, Hammond; Elliott Y. Spearin, Crown Point, all of Ind.

[73] Assignee: Inland Steel Company, Chicago, Ill.

[21] Appl. No.: 483,543

[22] Filed: Apr. 11, 1983

[51] Int. Cl.[3] ..... C10B 57/12

[52] U.S. Cl. ..... 201/20; 44/1 R; 44/1 F; 201/8; 201/9; 209/172

[58] Field of Search ..... 201/20, 25, 8, 9, 41; 209/172; 44/1 R, 1 F, 15 R

[56] References Cited

U.S. PATENT DOCUMENTS

| | | | |
|---|---|---|---|
| 1,925,005 | 8/1933 | Rose et al. | 44/1 |
| 2,109,234 | 2/1938 | Keenan | 233/1 |
| 2,150,899 | 3/1939 | Alexander et al. | 209/172 |
| 2,150,917 | 3/1939 | Foulke et al. | 209/172 |
| 2,151,578 | 3/1939 | Alexander et al. | 209/172 |
| 2,556,496 | 6/1957 | Hickey | 201/20 |
| 3,322,271 | 5/1967 | Edwards | 209/2 |
| 3,348,675 | 10/1967 | Tveter | 209/5 |
| 4,076,505 | 2/1978 | Dessau | 44/1 R |
| 4,173,530 | 11/1979 | Smith et al. | 209/9 |
| 4,244,699 | 1/1981 | Smith et al. | 44/1 SR |
| 4,252,639 | 2/1981 | Smith et al. | 209/172 |

FOREIGN PATENT DOCUMENTS 56-8487 1/1981 Japan .

OTHER PUBLICATIONS

W. L. O'Connell, "Properties of Heavy Liquids", Transactions of Society of Mining Engineers, Jun. 1963, pp. 126–132.

*Primary Examiner*—Jay H. Woo
*Assistant Examiner*—Mike McGurk
*Attorney, Agent, or Firm*—Marshall, O'Toole, Gerstein, Murray & Bicknell

[57] ABSTRACT

An improved process for making metallurgical coke is provided which enables the use of coals that ordinarily do not yield coke of expected stability based on the rank of the coal. The comminuted coal is pretreated by contacting and reacting the coal with a halogenated hydrocarbon liquid, particularly perchloroethylene, and the pretreated coal is thereafter subjected to high temperature carbonization.

16 Claims, 4 Drawing Figures

SOLVENT PRETREATMENT OF COAL TO IMPROVE COKE STRENGTH

This invention relates to the solvent pretreatment of coal to improve the quality of metallurgical coke obtained from the coal. Particularly, the invention relates to an improved coking process in which the coking coal is subjected to preliminary treatment with a halogenated hydrocarbon liquid in order to improve the stability index of the resultant coke.

BACKGROUND OF THE INVENTION

Probably the most important physical property of metallurgical coke is its strength or ability to withstand breakage and abrasion during handling and during its use in the blast furnace. The standard test to evaluate coke strength is the stability index test (ASTM D3402) which involves tumbling coke of selected size in a standard drum rotated for a specific time at a specific rate. The stability index is reported as the percentage of coke remaining on a one inch screen when the coke is screened after tumbling. In general, a stability index of at least about 50 to 60 is required for acceptable strength metallurgical coke. Preferably, the stability index should be at least about 50 to 55 for a small or medium blast furnace and at least about 58 to 60 for a large blast furnace.

Petrographic evaluation of coking coal is relied upon to predict the quality of the coke that can be expected, particularly the stability index of the coke. The basis for this reliance is evident from the findings of prior investigators, as reported in the technical literature, that the coking properties of coal depend on the coal's rank and its inert content. Coal rank is a measure of the degree of alteration of the coal-forming plants that has occurred because of geological factors. This degree of alteration is also affected by the types of original plant materials. Inerts are components of coal that do not react beneficially during the coking process. The inerts may be either inorganic minerals, which are non-coking, or organic macerals that have been severely altered and rendered poorly coking or non-coking by geological or environmental factors.

Coal rank may be measured chemically in terms of dry mineral matter-free volatile matter or may be measured petrographically in terms of vitrinite reflectance, in accordance with standard ASTM tests. It has been found that coal rank, as determined by these tests, generally correlates with coke stability. However, even if the rank of the coal indicates it should produce high coke stability and the mineral or ash content is normal, the actual stability of the coke may be low because of high organic inerts or because of atypical behavior of the non-inert portion of the coal. Furthermore, a coal that has been used successfully in the past to make coke with an acceptable stability index may sometimes undergo an apparent deterioration resulting in coke of inferior strength.

In the preparation of coal for coking, various coal cleaning or washing techniques are customarily used to remove high ash coal particles, solid foreign matter such as rock and slate, and other free impurities. The coal cleaning processes in current use are predominantly of the sink-float type in which cleaning is possible because of the difference in specific gravity between the free impurities or refuse (typically 1.8 to 6.0) and the coal particles (typically 1.25 to 1.55). A liquid separating medium or parting liquid is used which has an intermediate specific gravity such that the heavier refuse particles sink and the lighter coal particles float. In some cases the separating medium is an aqueous suspension of ground solids, such as sand, magnetite or barite. In other cases so-called high density or heavy liquids are used, such as aqueous calcium chloride solutions. Various halogenated hydrocarbons have also been proposed as high density liquids but have been used for the most part in coal washing laboratories. Examples of prior art patents showing the use of halogenated hydrocarbon liquids for coal cleaning are: Keenan Pat. No. 2,109,234; Alexander et al Pat. No. 2,150,899; Foulke et al Pat. No. 2,150,917; Alexander et al Pat. No. 2,151,578; Tveter Pat. No. 3,348,675; Dessau Pat. No. 4,076,505; Smith et al Pat. No. 4,173,530; and Smith et al Pat. No. 4,244,699.

Coal cleaning results in a reduction of the ash and sulfur content of the coal and in most instances improves the coking properties of the coal because of the lowering of the inorganic mineral content. For example, it is known that reduction of the ash content of coal by appropriate cleaning usually improves the stability index of the coke obtained from the coal. In the case of certain coals, however, reduction of the ash content by the usual cleaning methods does not result in sufficient improvement of the stability index of the resultant coke to make the coal acceptable for coking purposes.

Accordingly, a need has existed for a method of treating certain potentially useful coking coals to insure the production of coke having an acceptable stability index.

SUMMARY OF INVENTION

The broad object of the present invention is to provide a novel method of pretreating a coking coal so as to improve the quality of the metallurgical coke obtained by high temperature carbonization of the coal.

A more specific object of the invention is to provide a novel and improved process for making metallurgical coke in which the coking coal is pretreated with a halogenated hydrocarbon liquid in order to obtain a significant improvement in the stability index of the resulting coke.

The foregoing objects of the invention are achieved by contacting the coking coal in comminuted form with a halogenated hydrocarbon liquid solvent under conditions appropriate for obtaining effective mixing and contact of all of the solid coal particles with the liquid solvent. The coal pretreatment may be accomplished by contacting clean coal with liquid solvent in any suitable manner or by a sink-float cleaning or washing operation in which the liquid solvent is used as the high density medium for combined contacting and washing of either clean or raw coal.

The coals that are most responsive to this pretreatment are generally those that upon carbonization yield coke having a stability lower than expected based on the rank of the coal and the correlation between coke stability and coal rank as determined by standard volatile matter or reflectance tests. The preferred halogenated hydrocarbon solvent is perchloroethylene.

During the pretreating step the halogenated hydrocarbon solvent dissolves and reacts with certain components of the organic matrix of the coal to form a solvent induced reaction product that is soluble in the halogenated hydrocarbon solvent and is left on the coal particles as a surface deposit during volatilization and removal of residual solvent from the coal. As a result of this pretreatment, the stability index of the coke product is significantly improved as compared with the stability index of coke obtained from the same coal without pretreatment.

DETAILED DESCRIPTION

The pretreatment of coal in accordance with the present invention results in an unexpected improvement in coke strength or stability. This advantageous result is realized to the greatest extent when certain specific coals and solvents are used and when appropriately effective contacting methods are employed.

As explained above, there are certain coking coals having a normal inorganic mineral or ash content that fail to yield coke having the stability that is to be expected based on the rank of the coal and the correlation that has been found between coal rank and coke stability. The present invention is directed to the improvement of such coals.

The general concept of a relationship between coal rank and resulting coke stability has been recognized by prior investigators, e.g., as described in the following references:

Fieldner, A. C., et al, "Gas-, Coke-, and Byproduct-Making Properties of American Coals and Their Determination", U.S.B.M., Monograph No. 5,. 1934.

Russell, C. C., et al, "Some Physical Characteristics of By-Product Coke for Blast Furnaces", *Proc. Blast Furnace, Coke Oven, and Raw Materials,* AIME, No. 2, 1942, pp. 51–69.

Wolfson, D. E. et al, "Relation of Properties of Coke Produced by BM-AGA and Industrial Methods", *Proc. Blast Furnace, Coke Oven, and Raw Materials,* AIME, Vol. 20, 1961, pp. 387–403.

Benedict, L. G., et al, "Relationship Between Coal Petrographic Composition and Coke Stability", *Blast Furnace and Steel Plant,* Vol. 56, 1968, pp. 217–224.

Strassburger, J. H., ed., "Blast Furnace-Theory and Practice", Gordon and Breach Science Publishers, New York, 1969, pp. 325–436.

Ortoglio, C., et al. "Carbonization Yields, Analyses, and Physical Characteristics of Cokes from American Coals", U.S. ERDA, PERC-B-75/1, July, 1975.

Elliott, M. A., ed., "Chemistry of Coal Utilization", Second Supplementary Volume, John Wiley and Sons, New York, 1981, p. 952.

Figure 1:
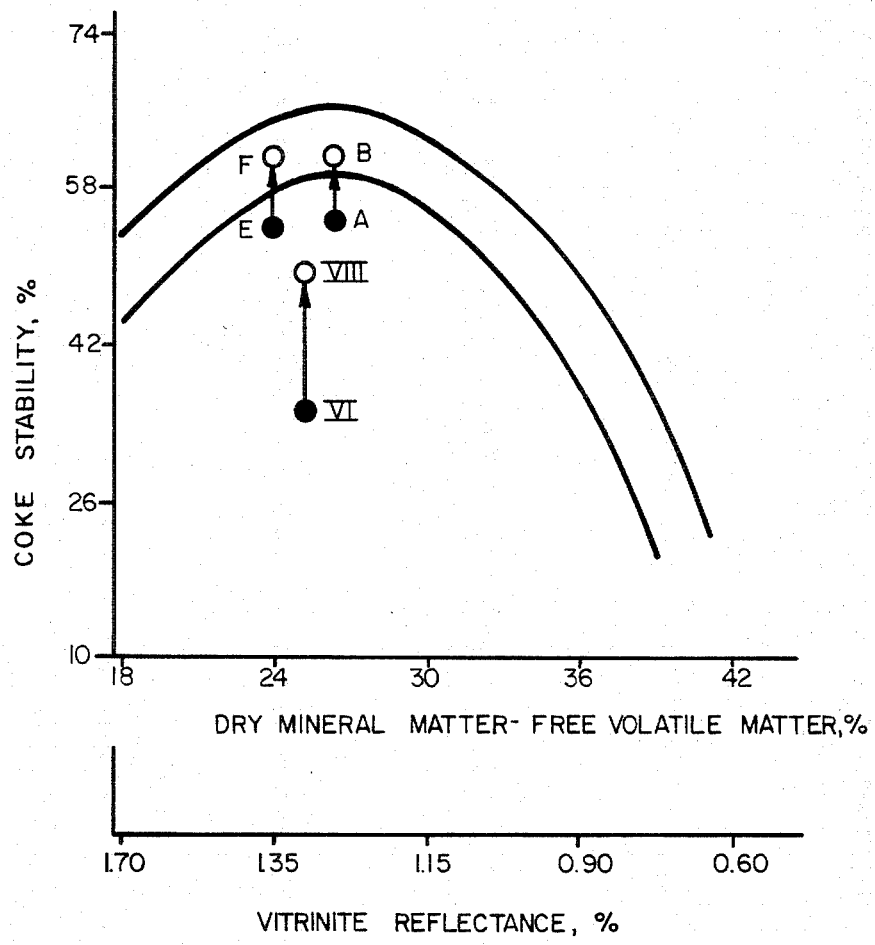
FIG. 1 is a graph showing the correlation between coal rank and coke stability.

FIG. 1 illustrates the non-linear correlation that has been found between coke stability and coal rank as specifically measured by the ASTM tests for either dry mineral matter-free volatile matter or vitrinite reflectance. The non-linear relationship is different for each method of measuring rank, and to permit both measurements to be shown on the same graph in FIG. 1 a uniform scale is used for volatile matter and a non-uniform scale for reflectance. The band defined by the upper and lower boundary curves in FIG. 1 is based on the results of coking tests using customary carbonization practices with a variety of low ash coals that either had a naturally low ash content or were cleaned in a conventional manner (without the use of a halogenated hydrocarbon separating liquid) to provide a low ash content.

It has been found that an inferior coal, i.e. one that fails to provide a coke stability within the expected range of the FIG. 1 band, can be pretreated with a halogenated hydrocarbon liquid in accordance with the present invention so that in many cases its coking properties are fully restored to provide a coke stability within the expected range of the FIG. 1 band. This effect is illustrated in FIG. 1 by the results of Tests A, B, E, and F which are described in detail in Example VI below.

Even if the coke stability obtained with the pretreated coal does not fall within the FIG. 1 band, the improvement will often be sufficient to permit the use of the coal in blends of two or more coking coals. An illustration of this aspect of the invention is also shown on FIG. 1 by the results of Tests VI and VIII which are described in detail in Example I below. From a practical standpoint the ability to upgrade a poor coking coal to the extent that it can be used in blends with other coking coals is a highly important advantage of the invention. The coke ovens in commercial use today are predominantly chemical recovery ovens of the vertical-slot type, commonly called by-product ovens. For the most part, ovens of this type require the use of coal blends or mixtures rather than single coals in order to avoid excessive oven pressures. High-volatile coal is often the principal constituent of such blends and may be mixed, for example, with 10 to 40% of a low-volatile coal. Medium-volatile coal is also commonly blended with high-volatile or low-volatile coals in two or three component mixtures. For example, high-volatile coal may be blended with 30–40% medium-volatile coal.

It will be seen from FIG. 1 that the highest coke stabilities are produced by coals that fall within the recognized definition of medium-volatile coals, i.e. coals having a volatile matter content between about 22% and about 31%. Consequently, the principles of the present invention are most clearly demonstrated by experimental work with medium-volatile coals, as described below in the specific examples. However, the invention is not limited to the pretreatment of medium-volatile coals but is broadly applicable to any coal, low-, high-, or medium-volatile, that does not provide the expected coke stability based on the correlation between coke stability and coal rank as measured by volatile matter content or reflectance, particularly as shown in FIG. 1. In many cases the coals that are responsive to the pretreatment method of the present invention will be found to exhibit the characteristics of oxidized coal or to contain high amounts of organic inerts or to possess unusual carbonization properties.

It is also desirable that the ash content of the coal pretreated in accordance with the present invention be low enough so that upon carbonization there is no substantial adverse effect on coke stability that is attributable to the ash content. Broadly speaking, an acceptable level of ash content may be from as low as 3% to as high as 12% in some instances, depending on the coke stability required. For United States coals, however, the ash content generally should be in the range of from about 4% to about 7%. The desired low level of ash may be achieved in some instances by selecting a coal having a natural low ash content. In most cases, however, the desired low ash content will be obtained by conventional cleaning or washing of the coal prior to the pretreatment step of the present invention or by conducting a combined pretreatment and cleaning operation using a halogenated hydrocarbon liquid as a high density medium. As hereinafter explained, the combined pretreatment and cleaning operation may be utilized either as a supplement to conventional cleaning in a coal preparation plant or as a substitute for conventional cleaning.

For purposes of the present invention, the solvent used for pretreating the coal may be any halogenated hydrocarbon liquid that is capable of dissolving and reacting to a limited extent with certain components of the organic matrix of the coal at ambient conditions of temperature and pressure to form a reaction product that has been designated for convenience as "solvent induced reaction product".

Although various halogenated hydrocarbon liquids will have utility in the present invention, we have obtained best results using tetrachloroethylene, more commonly known as perchloroethylene, and at least some of the coals tested appear to have a specific and highly advantageous response to treatment with perchloroethylene. Effective results have also been obtained using trichlorofluoromethane. In some cases it may be desirable to mix the halogenated hydrocarbon liquid with a suitable diluent to obtain a liquid of desired specific gravity for a particular application, usually within the range of from about 1.35 to about 1.65. Preferably, the diluent is another halogenated hydrocarbon liquid. For example, effective results have been obtained using perchloroethylene mixed with 1,1,1 trichloroethane as a diluent.

As described in more detail below, in the case of pretreatment of certain coals with perchloroethylene, it has been found that the solvent induced reaction product is a highly fluorescent substance that is not inherent in the untreated coal. In accordance with the test procedures, samples of the test coal were treated with perchloroethylene, the coal samples were separated from the perchloroethylene and dried, and the used perchloroethylene liquid was distilled to recover a solid residue of dissolved material. Thus, some of the solvent induced reaction product remained as reaction rim deposits around fissures and cavities in the surfaces of the dry coal particles, and the remainder of the solvent induced reaction product was recovered from the perchloroethylene solution. Microscopic examination of the coal surfaces under both white and blue reflected light showed a high degree of fluorescence of the solvent induced reaction product with the fluorescence spectra exhibiting peaks between 460 and 490 nm. When the solvent induced reaction product recovered from the perchlorethylene solution was microscopically examined under white reflected light, the residue appeared as lumps or nodules of a resinous pitch-like material that coats the coal particles. When examined under blue light, these nodules display fluorescent halos, and the fluorescence appears to be caused solely by the resinous material surrounding the non-fluorescent or weakly fluorescent coal particles. Infrared analysis of the solvent induced reaction product recovered from the perchloroethylene solution showed a strong aliphatic character as evidenced by absorption peaks at 2850, 2920, and 2950 $cm^{-1}$. The infrared analysis also showed that the solvent induced reaction product contained cyclic hydrogenated polynuclear aromatic compounds.

In carrying out the pretreatment of the coal with the halogenated hydrocarbon liquid solvent, the coal should be in particulate or comminuted form. The particle size is not critical, but the particles should be small enough to insure effective contact with the treating liquid but not so fine as to interfere with subsequent separation of the coal particles from the treating liquid and recovery of the treating liquid. As a practical matter, the coal can be prepared to the size distribution conventionally achieved in a coal preparation plant supplying coal to a metallurgical coking process, typically in the $-\frac{3}{4}$ inch range.

Any convenient solid-liquid contacting technique may be employed in pretreating the coal particles with the halogenated hydrocarbon liquid, but it is generally preferred that the coal particles be contacted with a substantial excess or bulk phase of treating liquid in order to insure effective pretreatment of the coal. Thus, it is desirable that the coal particles be immersed beneath the surface of a confined quantity or bath of treating liquid that is substantially greater than the amount of coal present. A contacting operation in which a relatively minor amount of treating liquid is present, such as in a slurry, can also be used, but better results have been obtained when the solvent was used as a bulk phase. Also, it has been found that for best results there should be a certain amount of relative movement between the coal particles and the pretreating liquid so that the solid and liquid phases are mixed or agitated in order to insure effective contact of all of the coal particles with the pretreating liquid. Static exposure of the coal to the liquid may not provide the desired result.

The pretreatment step of the present invention is carried out at ambient conditions of temperature and pressure since only a limited degree of coal-solvent reaction is required to obtain the benefits of the invention. This is in marked contrast with the prior art coal extraction processes operated at elevated temperature and pressures.

The coal can be pretreated with the halogenated hydrocarbon liquid either as raw coal or as coal that has already been cleaned. In either case, however, an advantageous mode of practicing the present invention is to utilize the halogenated hydrocarbon liquid as the high density medium in a combined pretreating and coal cleaning operation, as hereinafter described in greater detail. In this way, it will sometimes be possible to eliminate the conventional cleaning process.

In general, the method of the present invention may be practiced in three different modes. In Mode 1 low ash coal (either naturally low ash coal or coal that has been cleaned in a conventional manner) is treated with the halogenated hydrocarbon solvent without any separation of ash or refuse material. The coal-solvent contacting step may be carried out in any suitable equipment, e.g. an elongated screw conveyor into which the comminuted clean coal and liquid solvent are introduced and transported as a slurry. In Mode 2 low ash coal is introduced into a gravity separation tank containing a halogenated hydrocarbon bath so that a combined gravity separation and coal pretreatment operation is carried out. In this mode of operation if the low ash coal feed has been cleaned previously in the coal preparation plant, it is re-washed in the solvent treatment step for the added benefit of removing misplaced material. Mode 3 is similar to Mode 2 except that raw coal is used instead of clean coal. Accordingly, the amount of refuse material separated in the combined solvent treating and gravity separation step will be substantially greater for Mode 3 than for Mode 2.

Figure 2:
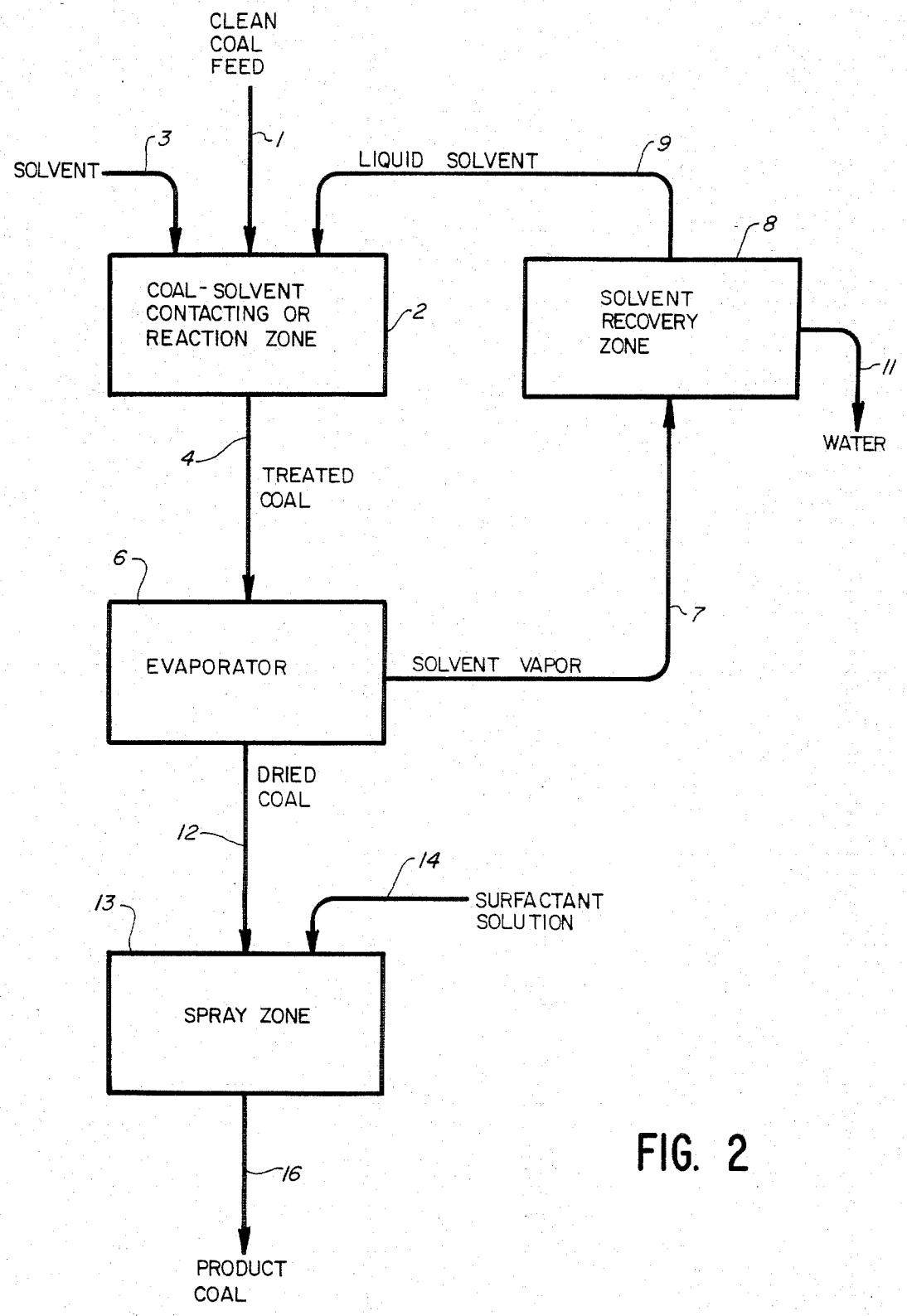
FIG. 2 is a schematic flowsheet of a specific embodiment of the coal pretreatment method of the present invention.

FIG. 2 illustrates schematically the practice of the invention in accordance with Mode 1 wherein the coal feed is pretreated with the solvent and there is no separation of refuse. Thus, a clean coal feed is introduced through line 1 to a coal-solvent contacting or reaction zone 2 where it is contacted with the halogenated hydrocarbon solvent introduced through lines 3 and 9. As previously mentioned, zone 2 may comprise any appropriate liquid-solid contacting apparatus or equipment, e.g. a screw conveyor which transports the coal and solvent as a slurry. Preferably, however, zone 2 will comprise an enlarged tank or vessel capable of holding a bulk phase or relatively large volume of treating liquid compared to the quantity of coal introduced into the vessel. Also, as previously explained, a certain minimal degree of agitation or mixing of the solid coal particles and liquid solvent should be provided in zone 2 in order to obtain the desired results. The required agitation or mixing may be accomplished by the manner of feeding the coal and the solvent into zone 2 or by any suitable mechanical or fluid agitation means.

The solvent treated coal particles are separated from the liquid phase and are removed from zone 2 through line 4 and introduced into an evaporator unit 6. In the evaporator 6 the halogenated hydrocarbon solvent that is adsorbed on the solid particles of treated coal is volatilized or evaporated, and the solvent vapors are passed through line 7 to a solvent recovery or compressor/-condenser zone 8. The solvent condensate is recycled from zone 8 through line 9 to zone 2, and any water present in the condensate is removed as a separate phase from zone 8 through line 11.

As previously explained, some of the solvent induced reaction product formed in zone 2 remains on the treated coal particles removed through line 4, but the removed coal particles also have a certain amount of adsorbed solvent that contains additional solvent induced reaction product in solution. In the evaporator 6, the residual solvent induced reaction product is precipitated from the solvent and is deposited on the surfaces of the coal particles during volatilization and removal of the solvent.

The dried coal product is conveyed through line 12 to a spray zone 13 where an aqueous surfactant solution is introduced through line 14 and sprayed onto the coal particles for the purpose of reducing dusting. The final product is removed through line 16.

Figure 3:
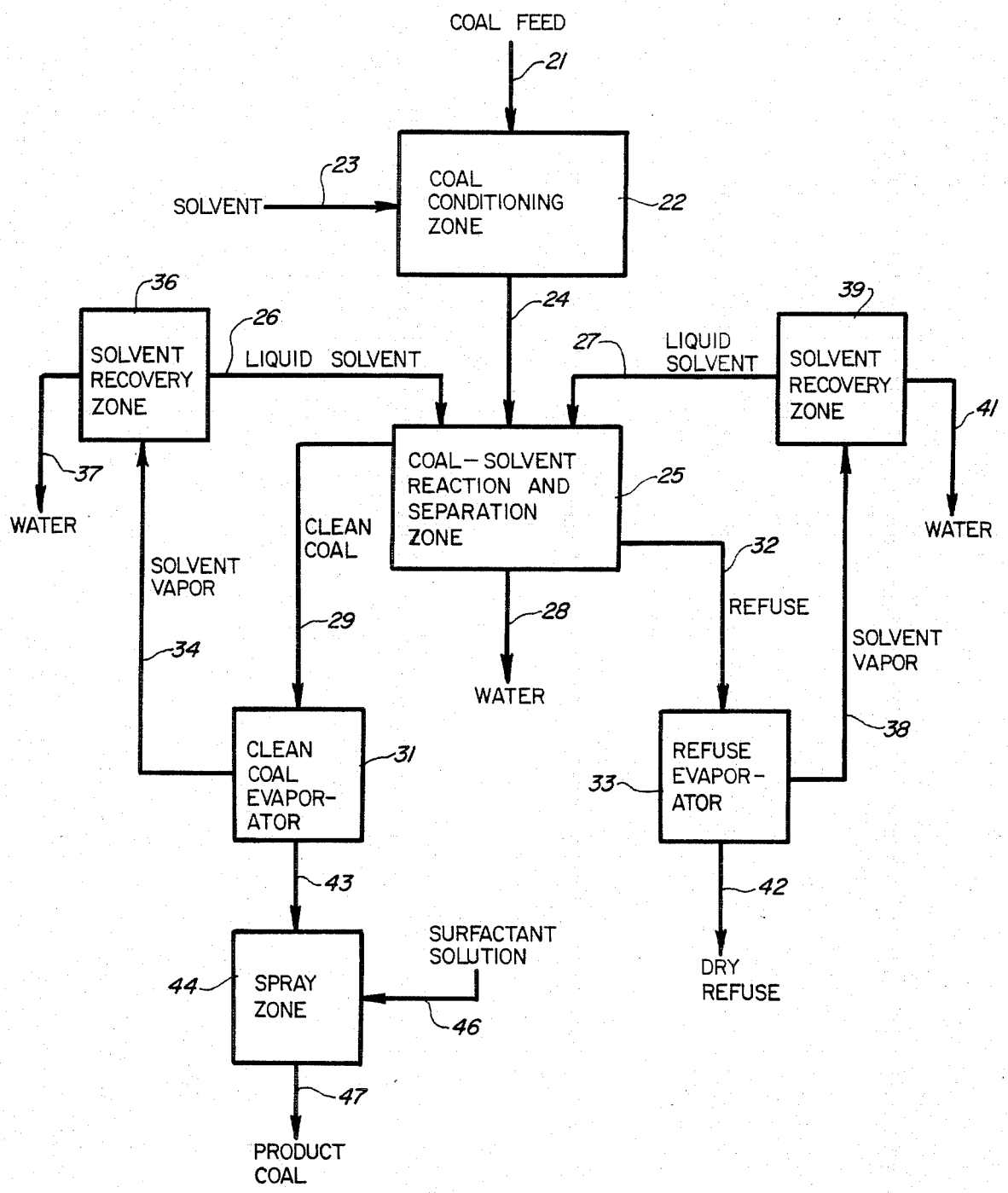
FIG. 3 is a schematic flowsheet showing another specific embodiment of the invention.

FIG. 3 illustrates schematically the practice of the invention in accordance with Mode 2 in which the halogenated hydrocarbon solvent is used not only for pretreating the coal to form the desired solvent induced reaction product but also as the high density medium for gravity separation of the desired product coal from undesired refuse material.

The coal feed is comminuted and introduced through line 21 to a coal conditioning zone 22 where it is contacted with the halogenated hydrocarbon solvent introduced through line 23. In the conditioning zone 22 the coal is pre-wetted with the liquid solvent, and conveniently the zone 22 may comprise a screw conveyor in which the coal and solvent are transported in slurry form.

The conditioned or pre-wetted coal passes from the conditioning zone 22 through line 24 to a reaction and gravity separation zone 25. The zone 25 may consist of a conventional bath-type separator unit or tank adapted to contain a relatively large volume of the halogenated hydrocarbon liquid separating medium. The main body of solvent making up the bath in the zone 25 is introduced to the zone 25 through lines 26 and 27 from a solvent recovery system hereinafter described. Thus, in the zone 25 the conditioned coal feed is contacted with a bulk phase of solvent, and the refuse material with a specific gravity greater than the liquid medium sinks to the bottom of the tank, whereas the clean coal floats at the surface of the bath. The tank 25 may be provided with the conventional drag chain conveyors (not shown) at the top and the bottom of the tank to remove the respective clean coal and refuse material. The feeding of the conditioned coal from the zone 22 into the zone 25 and the operation of the drag chain conveyors in the liquid bath in the zone 25 provide sufficient agitation and mixing to insure effective contact between the coal and the liquid solvent so as to obtain the desired solvent induced reaction product. If sufficient water is present in the feed coal, a separate water phase may be formed in the zone 25 which can be removed through line 28.

The resultant clean coal comprising the float product of the separation process is discharged through line 29 to a clean coal evaporator unit 31. The refuse material comprising the sink product of the gravity separation is discharged from zone 25 through line 32 to a refuse evaporator unit 33. The evaporators 31 and 33 may be indirect contact, screw-type, bulk material heaters in which the halogenated hydrocarbon solvent adsorbed on the solid particles is volatilized or evaporated. The solvent vapors from the clean coal evaporator 31 are passed through line 34 to a solvent recovery or compressor/condenser zone 36, and the solvent condensate is recycled through line 26 to the reaction and gravity separation tank 25. Any water present in the condensed solvent vapors may be removed from zone 36 as a separate phase through line 37. In a similar fashion, the halogenated hydrocarbon solvent adsorbed on the separated refuse material is volatilized or evaporated in zone 33, and the solvent vapors pass through line 38 to a solvent recovery or compressor-condenser zone 39. The solvent condensate is recycled through line 27 to the tank 25, and any water present in the condensate is removed as a separate phase from the zone 39 through line 41. The dry refuse material is discharged from the evaporator zone 33 through the line 42.

As previously explained, some of the solvent induced reaction product formed in the zone 25 remains on the clean coal particles removed through line 29, but the removed coal particles also have a certain amount of adsorbed solvent that contains additional solvent induced reaction product in solution. In the evaporator zone 31, the residual solvent induced reaction product is precipitated from the solvent and is deposited on the surfaces of the coal particles during volatilization and removal of the solvent. The dry coal product is conveyed through line 43 to a spray zone 44 where an aqueous surfactant solution is introduced through line 46 and sprayed onto the coal particles for the purpose of reducing dusting. The final product coal is removed through line 47.

As previously stated, the coal feed introduced to the conditioning zone 22 may be either raw coal or coal which has already been subjected to the usual cleaning or washing operation. In the event that pre-cleaned coal is introduced to zone 22, the operation in zone 25 is essentially a re-washing step in which additional refuse material is separated from the coal. In the event that raw coal is fed to the conditioning zone 22 (Mode 3), the illustrated system represents an actual replacement of the conventional coal preparation and cleaning operation.

Although the operating mode shown in FIG. 3 offers significant advantages because the zone 25 comprises a combined coal-solvent reaction zone and a gravity separation zone, it is to be understood that the invention is not so limited. An alternate mode of practicing the invention which will be more appropriate in certain circumstances consists of operating the zone 25 as a simple coal-solvent reaction or contacting zone without accomplishing any additional cleaning or separation, as previously described in connection with FIG. 2.

Figure 4:
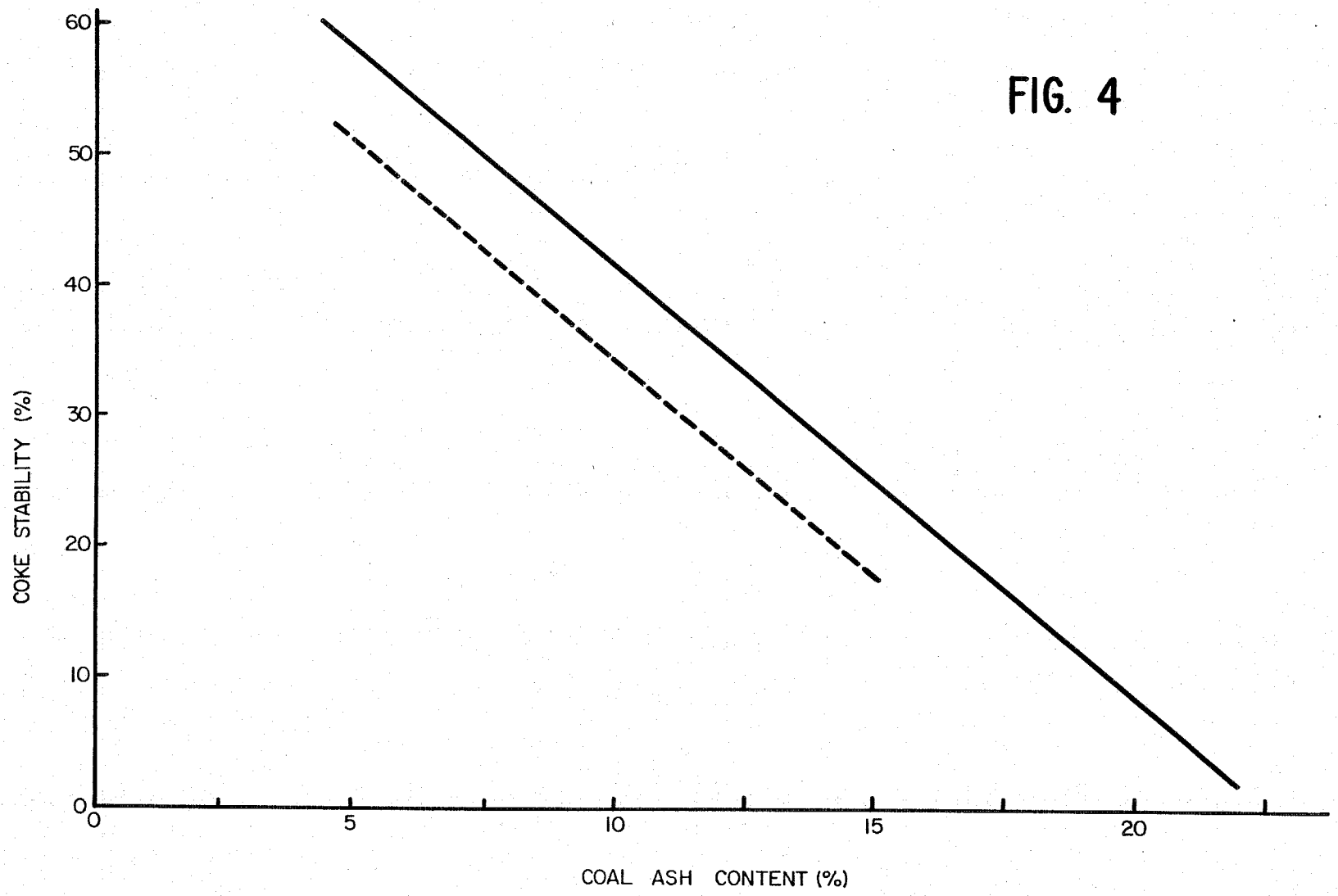
FIG. 4 is a graph comparing the effects on coke stability of ash content and of the pretreatment method of the present invention.

The improvement in coke stability obtained in accordance with the present invention is not simply due to a reduction in the ash content of the coal. In tests with perchloroethylene, it has been shown that the beneficial effect is the result of both ash reduction and the reaction of the perchloroethylene with the coal. FIG. 4 is an illustration of the effects of ash content and perchloroethylene pretreatment on coke stability based on the regressed data from many pilot coke oven tests. The broken line in FIG. 4 represents the tests conducted with untreated coal charges, and the solid line represents the tests conducted with perchloroethylene treated coal charges. While it is evident that a decrease in ash content enhances coke stability, it is also clear that the perchloroethylene treatment significantly increases coke stability at an equivalent ash content.

By means of the present invention a method is provided for obtaining commercially useful coking coals from coals that heretofore were considered of limited value for making metallurgical coke because of the unacceptable stability index of the coke. At best, some of these coals could only be used in relatively small amounts by blending them with superior coking coals. In many cases, by means of the present invention it is possible to improve these inferior coals to the extent that when subjected to high temperature carbonization the resultant coke has a minimum stability index in the range of from about 50 to about 60. However, as previously explained, even if the stability improvement is at a lower level, the upgraded coal may be used advantageously in blends.

In addition to the improvement in stability index, the coke obtained in accordance with the present invention also exhibits an increased hardness index, decreased reactivity, and increased tumble strength after reaction.

It is also significant that the solvent treatment of the present invention to form solvent induced reaction product does not result in any change in the inerts content or the petrographic indices of the coal as conventionally measured.

A very significant advantage of the present invention is that in many instances it will permit an increase in the productivity of the coke plant through a reduction in coking time. It is known that in high temperature carbonization of coal, the stability index of the coke product can be improved by increasing the coking time and thereby decreasing the coking rate. By means of the present invention, however, the pretreatment of the coal results in the desired improvement in stability index without the necessity of increasing the coking time and thereby decreasing the coking rate. As a result, it is possible to realize increased productivity without sacrificing coke quality, and in many circumstances an important economic advantage will be realized.

Although the advantages of the invention are obviously obtainable by pretreating all of the coal charged to the coke oven, it should also be understood that the solvent pretreated coal can be blended with the same or a different coal that has not been solvent pretreated in accordance with the invention. In the case of such blends, the improvement in stability index that is obtained will be a function of the amount of pretreated coal in the blend.

The following non-limiting specific examples are further illustrative of the present invention.

EXAMPLE I

An experimental program was conducted to evaluate the commercial feasibility of producing acceptable quality metallurgical coke from a test coal that had been pretreated with perchloroethylene in accordance with the FIG. 2 mode of the present invention, i.e. contacting and reacting the coal with the solvent without refuse rejection, as illustrated in FIG. 2. The test coal had a volatile matter content of about 24% and a vitrinite reflectance of about 1.30% and without pretreatment yielded a coke of poor stability.

The test coal was subjected to conventional cleaning (magnetite slurry, shaking tables, and froth flotation) in the preparation plant at the mine to obtain a clean coal, but the ash content of the clean coal was substantially higher than usual. One portion of the clean coal ($9.5\times0$ mm) was pretreated with perchloroethylene in a large scale pilot washer that was modified to eliminate the refuse rejection function, and the treated coal was air dried over an extended period of time by spreading the coal in low flat piles and turning the piles over frequently. Another portion of the clean coal was screened at 0.59 mm, and the $+0.59$ mm material was washed with perchloroethylene in a small scale pilot washer and dried in a rotary dryer having a gas heater. To simulate the Mode 1 operation, the $-0.59$ mm material and the refuse material rejected during the washing step were combined with the washed $+0.59$ mm material to obtain the samples used in the coking tests.

Coking tests were conducted both in a pilot coke oven and in full size commercial nonrecovery coke ovens. The pilot coke oven and its operation have been described in the technical literature (Kaegi, D. D. and Osterman, C. A., "The Use of Illinois Coal For the Production of High Quality Coke", ISS-AIME Ironmaking Proceedings, Vol. 39, 1980, pp 239–248).

The operating conditions and results of the pilot coke oven tests are shown in Table 1 in which Test I used untreated coal as a control and Tests II and IV used coal treated according to the Mode 1 operation in the large scale and small scale pilot washers, respectively. For comparison purposes, Test III was also made in which the coal was treated in the small scale pilot washer using Mode 2 of the invention, i.e. combined solvent treatment and refuse rejection, as illustrated in FIG. 3. The results of the commercial nonrecovery coke oven tests are shown in Table 2.

TABLE 1

| | Test | | | |
|---|---|---|---|---|
| | I Control | II Mode 1 (large scale washer) | III Mode 2 (small scale washer) | IV Mode 1 (small scale washer) |
| Proximate Analysis, Coal | | | | |
| Volatile Matter, % | 23.9 | 22.8 | 24.4 | 22.1 |
| Fixed Carbon, % | 67.3 | 69.4 | 70.4 | 70.0 |
| Ash, % | 8.8 | 7.8 | 5.2 | 7.9 |
| Sulfur, % | 0.68 | 0.71 | 0.66 | 0.73 |
| F.S.I. | 9.0 | 8.5 | 6.5 | 7.0 |
| Coal Charging Parameters | | | | |
| Coal Bulk Density, kg/m$^3$ | 792 | 777 | 810 | 799 |
| Moisture, % | 1.8 | 4.2 | 1.8 | 3.4 |
| Pulverization, % −3.35 mm | 94 | 93 | 96 | 93 |
| Test Operation | | | | |
| Total Wt. of Charge (Dry), kg | 551 | 527 | 557 | 542 |
| Flue Temp., Deg C. | 1204 | 1204 | 1204 | 1204 |
| Max. Wall Pressure, kPa | 24.24 | 18.02 | 31.90 | 12.60 |
| Temp. at Center When Pushed, Deg C. | 982 | 982 | 982 | 982 |
| Coking Time, Hours | 14.68 | 14.08 | 14.27 | 14.15 |
| Coking Rate, mm/Hr | 31.14 | 32.46 | 32.05 | 32.31 |
| Yield (Dry Basis), % | 79.7 | 77.1 | 79.7 | 79.9 |
| Coke Characteristics | | | | |
| Average Coke Size, mm | 66.8 | 65.0 | 61.5 | 65.5 |
| Stability | 33.4 | 39.9 | 57.9 | 44.9 |
| Hardness | 66.2 | 65.1 | 69.9 | 68.6 |

TABLE 2

| | Untreated Coal | | Treated Coal | |
|---|---|---|---|---|
| | Test | | | |
| | V | VI | VII | VIII |
| | Oven | | | |
| | A | B | A | B |
| Coke | | | | |
| Avg. Size (mm) | 46.2 | 44.7 | 50.3 | 53.5 |
| Stability | 40.8 | 34.1 | 47.1 | 48.6 |
| Hardness | 62.3 | 59.5 | 62.1 | 60.3 |

From Table 1 it will be seen that the coke obtained in Test I (the control) had poor stability (33.4) largely because of the higher than normal ash content (8.8%) of the test coal. In Test II the coal treated with perchloroethylene in the large scale pilot washer and air dried showed a coke stability of 39.9 representing an improvement of 6.5 points. In Test IV in which the coal had been treated with perchloroethylene in the small scale pilot washer and dried in a rotary dryer with gas heater, an even greater improvement of coke stability (44.9) was obtained. Test III shows that the combined effects of perchloroethylene treatment and ash removal as a result of refuse rejection in the small scale pilot washer produced a coke stability of 57.9. This represents an improvement of 24.5 points of which 11.5 points are attributable to the perchloroethylene treatment and 13 points are attributable to the reduction of the ash content to 5.2%.

Table 2 shows the properties of the coke produced in two different commercial nonrecovery coke ovens using both untreated coal and coal treated with perchloroethylene in the large scale pilot washer. It will be seen that the coke obtained from the treated coal has a larger average size and a higher stability than the coke produced from untreated coal.

EXAMPLE II

Another experimental program was conducted to evaluate, among other objectives, Mode 1 of practicing the invention using the same type of clean coal used in Example I but with a lower ash content. The tests were made in the same pilot coke oven described in Example I. The test coal (9×0 mm) was treated with perchloroethylene in the same large scale pilot washer used in Example I with the same modification of the operation to eliminate the refuse rejection function. The test results are summarized in Table 3.

TABLE 3

| | Untreated Test Coal (Control) | Treated Test Coal | |
|---|---|---|---|
| | Test | | |
| | IX | X | XI |
| Ash Content (%) | 6.1 | 5.9 | 6.0 |
| Coke Stability (%) | 48.6 | 51.2 | 52.8 |
| Coke Hardness (%) | 67.2 | 68.3 | 67.5 |
| Average Coke Size (mm) | 64.5 | 62.7 | 67.0 |
| Oven Charge Bulk Density (kg/m$^3$) | 891 | 873 | 857 |
| Actual Coking Time (h) | 16.6 | 15.2 | 15.2 |

It will be seen from Table 3 that the perchloroethylene treatment caused an average stability improvement of 3.4 points. Although not as large as the increase in stability obtained in the Example I tests, this is a significant increase in view of the fact that the coke obtained from the untreated coal had a higher stability index (48.6) as a result of the lower ash content (6.1%) of the coal as compared with the coal used in Example I. The test data also show that there was a reduction in coking time associated with the perchloroethylene treatment. A statistical analysis of the data showed that the reduction in coking time was not due to any known coking parameters and thereby indicated that the perchloroethylene treatment changed the fundamental properties of the coal.

EXAMPLE III

Another comparison similar to that of Example II was made using the same type of clean coal and the same pilot coke oven. In this instance, however, the untreated test coal had an even lower ash content of 5.6%, and the perchloroethylene treatment was carried out in the same small scale pilot washer described in Example I to simulate the Mode 1 operation.

The stability of the coke obtained from the untreated coal was 56.8, which is relatively high as a result of the low ash content of the coal. Nevertheless, the perchloroethyelene treatment resulted in a significant increase in coke stability to 58.7.

EXAMPLE IV

A 2400 kg sample of the same type of clean coal used in Examples I–III was evaluated for its response to solvent treatment using perchloroethylene in accordance with the present invention. The sample was screened at 0.59 mm, the +0.59 mm material was split into four portions, and these portions were treated in the following manner:

In Test XII, one of the portions was recombined with one-fourth of the −0.59 mm material to form a control sample which was essentially the same as the as-received test coal.

In Test XIII, a second portion of the +0.59 mm material was contacted with perchloroethylene in a pilot scale heavy medium drag tank in accordance with Mode 2 of the invention. The solvent treated coal was removed and was tumble dried in a cement mixer equipped with a forced-air drying system to remove perchloroethylene and water vapors. After this sample was tumble dried until no evidence of organic liquid was apparent, it was recombined with a proportionate amount of the −0.59 mm material.

In Test XIV, a third portion of the +0.59 mm coal was contacted with perchloroethylene in the same manner as in Test XIII, but the treated coal was then spread on the floor and allowed to dry in the open atmosphere for 48 hours. The dried sample was then recombined with a corresponding quantity of the −0.59 mm material.

In Test XV, the fourth sample of +0.59 mm coal was subjected only to tumbling for a length of time such that its size distribution was similar to that obtained in Test XIII. The tumbled sample was then recombined with an equivalent amount of the −0.59 mm material.

Each of the above-described coal samples was then carbonized in the same pilot coke oven used in the previous examples. The coal properties and carbonization results from the coke oven tests are shown in Table 4.

TABLE 4

| | Test | | | |
|---|---|---|---|---|
| Sample History | XII As Received Test Coal | XIII Drag Tank and Tumble Dry | XIV Drag Tank and Floor Dry | XV Tumble Only |
| Coal | | | | |
| Moisture, wt. % | 1.2 | 2.4 | 1.5 | 1.4 |
| Ash, wt. % | 5.4 | 5.0 | 4.8 | 4.8 |
| Pulverization, % −3.5 mm | 94 | 93 | 94 | 94 |
| Coal Bulk Density, kg/m$^3$ | 803 | 799 | 805 | 800 |
| Coke | | | | |
| Average Coke Size, mm | 63.8 | 63.0 | 63.2 | 63.2 |
| Stability Index | 54.8 | 59.9 | 58.6 | 56.0 |
| Hardness Index | 67.5 | 70.1 | 69.2 | 69.5 |

Because the test coal was previously cleaned, there was minimal refuse rejection during the contacting operation of Tests XIII and XIV. Thus, the effect of the perchloroethylene treatment or the tumbling step, or the interaction of both, could be isolated and evaluated. As seen in Table 4, the stability of the coke from the untreated coal in Test XII was 54.8, whereas the complete treatment in Test XIII resulted in a significant increase of the stability to 59.9. A comparison of the results of Tests XII, XIV and XV shows that the treatment of the coal with perchloroethylene has the greatest effect on stability improvement.

The importance of mechanical agitation of the coal was further shown by Tests XVI and XVII in which samples of cleaned test coal were exposed to a solvent mixture of 50% perchloroethylene and 50% 1,1,1 trichloroethane in static soaking tests in large drums. As shown by the data in Table 5, the stability of the resultant coke was unaffected by mere exposure of the coal to the organic solvent without mechanical agitation.

TABLE 5

| | Test | |
|---|---|---|
| Sample History | XVI Untreated Test Coal | XVII Test Coal Treated With 50—50 Mix Trichloroethane and Perchloroethylene |
| Coal | | |
| Moisture, wt. % | 3.9 | 1.3 |
| Ash, wt. % | 5.9 | 5.7 |
| Pulverization, % −3.5 mm | 70 | 64 |
| Coal Bulk Density, kg/m$^3$ | 795 | 791 |
| Coke | | |
| Average Coke Size, mm | 66.8 | 62.5 |
| Stability Index | 44.0 | 43.8 |
| Hardness Index | 68.3 | 70.1 |

EXAMPLE V

A study was made to determine the nature of the solvent induced reaction product obtained by contacting the same type of coal of the previous examples with perchloroethylene.

Blocks of test coal were dipped in perchloroethylene for 15 minutes, 3 hours, 12 hours, and 24 hours, respectively. The treated and untreated coal surfaces were then examined microscopically under white reflected and under blue reflected light. In addition, the solvent induced reaction product dissolved in the perchloroethylene was separated by boiling off the perchloroethylene and recovering the residue for microscopic examination and FTIR (Fourier Transform Infrared) analysis. The residue produced by boiling off perchloroethylene was a resinous pitchy material, and the dried material as deposited on the coal surface was composed of nodules of a resinous pitch-like material coating the coal particles.

Under reflected blue light (<500 nm) the solvent induced reaction product was observed to be highly fluorescent with the nodules displaying fluorescent halos and the fluorescence spectra exhibiting peaks between 460 and 490 nm. The fluorescence was caused solely by the resinous material surrounding the non-fluorescent or weakly fluorescent coal particles. Infrared analysis of the residue showed a strong aliphatic characteristic as evidenced by absorption peaks at 2850, 2920, and 2950 cm$^{-1}$. The infrared analysis also showed absorption peaks characteristic of the presence of cyclic hydrogenated polynuclear aromatic compounds.

EXAMPLE VI

An experimental program was carried out to compare the response of seven test coal samples to perchloroethylene treatment essentially in accordance with Mode 1 of the present invention.

A pile sample of each test coal large enough to make up two test oven charges (1200 kg) was screened at 0.59 mm. Half of the +0.59 mm material was recombined with half of the −0.59 mm material for use as a control. The other half of the +0.59 mm material was treated in perchloroethylene and combined with the remainder of the untreated −0.59 mm material. The contacting procedure consisted of immersing the coal in a drag tank filled with perchloroethylene and conveying the material by the drag chain conveyor through the perchloroethylene bath to a rotary dryer fitted with two natural gas radiant heaters. The perchloroethylene treated material was then tumbled for eight hours while heated to dryness. The control samples and the treated samples were then subjected to high temperature carbonization in the same test oven previously described.

The results of the coking tests are set forth in Table 6, and Table 7 shows the relationship between the stability change due to perchloroethylene treatment and the volatile matter content and reflectance values for the respective test coals.

TABLE 6

| Test | Coal Type and Treatment | Coke Quality Sta-bility | Hard-ness | Avg. Size (mm) | Coking Time (hr.) |
|---|---|---|---|---|---|
| A | Coal 1 (control) | 53.1 | 68.0 | 57.0 | 17.3 |
| B | Coal 1 (treated) | 59.2 | 71.6 | 58.9 | 16.9 |
| C | Coal 2 (control) | 54.0 | 67.4 | 64.0 | 15.5 |
| D | Coal 2 (treated) | 59.8 | 67.8 | 60.5 | 14.9 |
| E | Coal 3 (control) | 54.0 | 69.8 | 61.5 | 14.8 |
| F | Coal 3 (treated) | 59.9 | 72.1 | 61.0 | 14.8 |
| G | Coal 4 (control) | 54.8 | 67.5 | 63.8 | 16.8 |
| H | Coal 4 (treated) | 59.9 | 70.1 | 63.0 | 15.8 |
| I | Coal 5 (control) | 60.6 | 68.9 | 63.2 | 14.9 |
| J | Coal 5 (treated) | 59.4 | 68.6 | 63.0 | 14.5 |
| K | Coal 6 (control) | 61.3 | 69.3 | 65.3 | 15.9 |
| L | Coal 6 (treated) | 62.9 | 69.1 | 64.5 | 15.0 |
| M | Coal 7 (control) | 61.4 | 68.3 | 64.8 | 15.3 |
| N | Coal 7 (treated) | 62.6 | 70.4 | 61.0 | 14.8 |

TABLE 7

| Test | Mineral Matter-Free Volatile Matter, % | Mean Maximum Vitrinite Re-flectance, % | Control Coke Stability | Stability Change Due To Treatment |
|---|---|---|---|---|
| A-B (Coal 1) | 26.2 | 1.26 | 53.1 | +6.1 |
| C-D (Coal 2) | 23.8 | 1.37 | 54.0 | +5.8 |
| E-F (Coal 3) | 24.1 | 1.35 | 54.0 | +5.9 |
| G-H (Coal 4) | 24.2 | 1.33 | 54.8 | +5.1 |
| I-J (Coal 5) | 26.7 | 1.21 | 60.6 | −1.2 |
| K-L (Coal 6) | 25.4 | 1.30 | 61.3 | +1.6 |
| M-N (Coal 7) | 24.4 | 1.33 | 61.4 | +1.2 |

As will be seen from the data in Table 7, the greatest improvement in stability index was obtained with coals 1-4. In each case the control coke stability was below the FIG. 1 band, but the pretreatment with perchloroethylene results in a greatly improved coke stability that was within the FIG. 1 band of expected stability based on rank. For coals 5-7, the changes in stability index were minimal and approached the reproducibility limits of the test. It should be noted, however, that the control coke stability for coals 5-7 was already high and well within the FIG. 1 band.

EXAMPLE VII

Using the same type of test coal used in Examples I-IV, tests were made to evaluate perchloroethylene treatment according to Modes 2 and 3 of the invention in comparison with the results obtained with a typical clean coal product from a commercial coal preparation plant. Samples of both the raw coal feed and the clean coal product were obtained simultaneously from the coal preparation plant.

The raw coal sample was screened to obtain three fractions: +9.5 mm, −9.5×+0.6 mm, and −0.6 mm. The small scale pilot washer previously described was used to wash the larger size fractions and separate refuse or ash. The +9.5 mm fraction was washed with a blend of perchloroethylene and 1,1,1 trichloroethane having a specific gravity of 1.55, and the −9.5×+0.6 mm fraction was washed with perchloroethylene alone having a specific gravity of 1.61. Because of the limitations of the pilot equipment, the −0.6 mm material was washed separately in a pilot scale flotation cell using a mixture of fuel oil and Nalco 8836 frother. The washed fractions were air dried in the pilot rotary dryer. The flotation cell product was dried by heating. All size fractions were recombined to provide the pilot test oven charges.

The clean coal sample having a size distribution of 9.5×0 mm was screened at 0.6 mm, and the 9.5×+0.6 mm fraction was washed in perchloroethylene alone and then recombined with the −0.6 mm fraction to provide the pilot test oven charges.

Pilot oven carbonization tests were then made on the preparation plant clean coal, pretreated raw coal (Mode 3), and pretreated preparation plant clean coal (Mode 2). The results of these tests are shown in Table 8.

TABLE 8

| | Test O Preparation Plant Clean Coal | P Pretreated Clean Coal | Q Pretreated Raw Coal |
|---|---|---|---|
| Coal Analysis, % | | | |
| Ash-Free Volatile Matter | 24.5 | 23.6 | 24.2 |
| Ash | 4.9 | 5.0 | 6.1 |
| Sulfur | 0.73 | 0.71 | 0.69 |
| Coke Characteristics | | | |
| Average Size, mm | 61.7 | 60.5 | 66.8 |
| Hardness | 66.9 | 67.8 | 68.4 |
| Stability | 52.8 | 59.8 | 57.6 |

As seen in Table 8, pretreatment of raw coal (Test Q) resulted in a coke stability of 57.6 and pretreatment of clean coal (Test P) resulted in a coke stability of 59.8, as compared to a coke stability of 52.8 obtained with the preparation plant clean coal (Test O). Thus, pretreatment of clean coal increased coke stability 7 points over that of preparation plant clean coal at equivalent ash contents, and pretreatment of raw coal increased coke stability 4.8 points over that of preparation plant clean coal even though the pretreated coal had a higher ash content.

EXAMPLE VIII

Tests were made using the same type of clean coal used in Examples I-IV and VII. The test procedure was the same as that described in Example VI using Mode 2 of the invention. However, in this case the halogenated hydrocarbon liquid was trichlorofluoromethane.

The pertinent test data are shown in Table 9.

TABLE 9

| | Test R (Control) | S (Treated) | T (Treated) |
|---|---|---|---|
| Coal | | | |
| Moisture, wt. % | 2.2 | 1.2 | 1.4 |
| Ash, wt. % | 5.1 | 4.8 | 5.0 |
| Pulverization, % −3.5 mm | 94 | 95 | 93 |
| Coal Bulk Density, kg/m$^3$ | 794 | 809 | 808 |
| Coke | | | |
| Avg. Coke Size, mm | 59.4 | 56.1 | 57.4 |
| Stability Index, % | 53.7 | 58.7 | 56.2 |

TABLE 9-continued

| | Test | | |
|---|---|---|---|
| | R (Control) | S (Treated) | T (Treated) |
| Hardness Index, % | 69.9 | 69.6 | 69.3 |

As seen in Table 9, the control coal sample in Test R had a low ash content (5.1%) and yielded a relatively high coke stability of 53.7. However, pretreatment of the test coal with trichlorofluoromethane in Tests S and T resulted in significant increases of coke stability to 58.7 and 56.2, respectively, at essentially the same ash level as the control.

In summary, the present invention provides an improvement in the high temperature carbonization of coal for making metallurgical coke of acceptable strength that enables the use of certain coals that heretofore were not useful or had only limited utility because they did not yield coke having a satisfactory stability index. The pretreatment of such coals with halogenated hydrocarbon liquids, particularly perchloroethylene, in accordance with the present invention changes the coking properties of the coal so that coke of acceptable stability index can be obtained.

Although halogenated hydrocarbons have been suggested in the prior art as heavy medium gravity separation liquids for coal cleaning, it was unknown prior to the present invention that the pretreatment and reaction of certain coals with halogenated hydrocarbon liquids in the manner described herein would have a beneficial effect on the quality of the metallurgical coke produced by carbonization of such pretreated coals.

Although it is not to be regarded as a binding explanation, our suggested hypothesis is that limited chemical reaction of the halogenated hydrocarbon solvent with certain macerals (inert or semi-inert macerals or macerals that have been oxidized or that have unusual carbonization properties) provides a solvent induced reaction product residue on the coal particles that is highly reactive and thereby increases the reactive-to-inerts ratio at the coal particle surfaces. In addition, activation of the coal inerts to a more reactive state may also occur as a result of cleavage of ether bridges or similar oxygen structures in the coal during exposure to the solvent and subsequent drying. In specific cases, the solvent induced reaction product is highly aliphatic and contains cyclic hydrogenated polynuclear aromatic compounds that may also promote high fluidity at surface sites on the treated coal particles, thereby providing more intimate particle-to-particle wetting and leading to more effective bonding of the carbon matrix during carbonization.

We claim:

1. In the high temperature carbonization of coking coal for making metallurgical coke, the improvement enabling the use of an inferior coking coal by pretreating the coal, comprising the steps of:

providing a coking coal that, prior to treatment, does not yield coke having the expected stability index based on the rank of the coal, contacting the coal in comminuted form with a halogenated hydrocarbon liquid under conditions to effect limited dissolution of, and reaction of the halogenated hydrocarbon liquid with, organic components of the coal to form a solvent induced reaction product that is soluble in said halogenated hydrocarbon liquid, separating the coal particles from the halogenated hydrocarbon liquid, effecting volatilization and removal of residual halogenated hydrocarbon liquid from the coal particles and thereby depositing dissolved reaction product on the surfaces of the coal particles, and thereafter subjecting the pretreated coal to high temperature carbonization, whereby to obtain metallurgical coke having an improved stability index and wherein the improvement in stability index is greater than that attributable to a reduction in the ash content of the coal.

2. The method of claim 1, wherein said coal, prior to pretreatment, produces coke having a stability index less than expected based on the correlation between coke stability and coal rank as measured by dry mineral matter-free volatile matter content or by vitrinite reflectance.

3. The method claim 1, wherein said coal, prior to pretreatment, produces coke having a stability index less than expected based on the correlation between coal rank and coke stability as shown in FIG. 1.

4. The method of claim 1, wherein said halogenated hydrocarbon liquid is selected from the group consisting of perchoroethylene, trichlorofluoromethane, and a mixture of perchloroethylene and 1,1,1 trichloroethane.

5. The method of claim 1, wherein said halogenated hydrocarbon liquid comprises perchloroethylene.

6. The method of claim 1 wherein said halogenated hydrocarbon liquid comprises perchloroethylene and a diluent.

7. The method of claim 1, wherein said contacting step is conducted at ambient conditions of temperature and pressure.

8. The method of claim 1, wherein said contacting step is conducted with sufficient agitation to obtain effective contact of all of the coal particles with the halogenated hydrocarbon liquid.

9. The method of claim 1, wherein said halogenated hydrocarbon liquid is adapted to be used as a heavy liquid gravity separation medium, and said contacting step is conducted by immersing the pulverized coal in a bath of said liquid and separating the coal float phase.

10. The method of claim 1, wherein the improved stability index of the coke is in the range of from about 50 to about 60.

11. The method of claim 1 wherein the pretreated coal is blended with another coking coal prior to carbonization.

12. The method of claim 1 wherein said coal is a medium-volatile coal.

13. The method of claim 1 wherein the ash content of the pretreated coal is from about 4% to about 7%.

14. In the high temperature carbonization of coking coal for making metallurgical coke, the improvement enabling the use of an inferior coking coal that does not yield coke having the expected stability index based on the rank of the coal, comprising the steps of:

providing said inferior coking coal in comminuted form, pretreating the comminuted coal by contacting it with liquid perchloroethylene under ambient conditions of temperature and pressure and with sufficient agitation to obtain effective contact of all of the coal particles with the perchloroethylene, said perchloroethylene effecting limited dissolution of, and reaction of the perchloroethylene with, organic components of the coal to form a solvent induced reaction product that is soluble in said perchloroethylene, separating the coal particles from the perchloroethylene, effecting volatilization and removal of residual perchloroethylene from the coal particles and thereby depositing dissolved reaction product on the surfaces of the coal particles, and thereafter subjecting the pretreated coal to high temperature carbonization, whereby to obtain metallurgical coke having an improved stability index and wherein the improvement in stability index is greater than that attributable to a reduction in the ash content of the coal.

15. The method of claim 14, wherein said perchloroethylene is used as a heavy liquid gravity separation medium, and said contacting step is conducted by immersing the comminuted coal in a bath of perchloroethylene and separating the coal float phase.

16. The method of claim 14, wherein the improved stability index of the coke is in the range of from about 50 to about 60.

* * * * *